US007367197B1

(12) United States Patent
Reil et al.

(10) Patent No.: US 7,367,197 B1
(45) Date of Patent: May 6, 2008

(54) REFRIGERATED OPEN CONDIMENT RAIL

(75) Inventors: James P. Reil, Royse City, TX (US); Nitish Vashishta, Dallas, TX (US)

(73) Assignee: H & K Dallas, Inc., Dallas, TX (US)

( * ) Notice: Subject to any disclaimer, the term of this patent is extended or adjusted under 35 U.S.C. 154(b) by 245 days.

(21) Appl. No.: 10/934,941

(22) Filed: Sep. 3, 2004

(51) Int. Cl.
*F25D 23/12* (2006.01)

(52) U.S. Cl. ..... 62/89; 62/258

(58) Field of Classification Search ..... 62/258, 62/458, 89, DIG. 1, 440–441, 246–256, 457.1–457.9, 62/404–426
See application file for complete search history.

(56) References Cited

U.S. PATENT DOCUMENTS 4,685,311 A * 8/1987 Rastelli ..... 62/258
5,117,649 A * 6/1992 Mangini et al. ..... 62/251
5,317,881 A * 6/1994 Colvin ..... 62/209
5,477,702 A * 12/1995 Kennedy et al. ..... 62/256
6,089,036 A * 7/2000 Carlson et al. ..... 62/256
6,363,672 B1 * 4/2002 Baker ..... 52/233
6,434,961 B2 * 8/2002 Richmond et al. ..... 62/258
6,557,363 B1 * 5/2003 Haasis et al. ..... 62/258
6,564,569 B1 * 5/2003 Havens ..... 62/258
6,564,570 B2 * 5/2003 Koike et al. ..... 62/258

* cited by examiner

*Primary Examiner*—William E. Tapolcai
(74) *Attorney, Agent, or Firm*—Fulbright & Jaworski LLP

(57) ABSTRACT

Systems and methods are disclosed for maintaining a low internal temperature in items held in an open container system. Example embodiments generate a stationary, insulating layer of cold air that covers the exposed surface and slows the transfer of heat from the environment. One example embodiment includes a storage container employing a free convection cooling mechanism adjacent to an exposed surface of a perishable. The free convection cooling mechanism acts to chill the air immediately above the exposed surface, thereby creating an insulating layer of cold air. By raising or lowering the temperature of this layer, the example embodiment may further be able to raise or lower the internal temperature of the perishable.

28 Claims, 2 Drawing Sheets

REFRIGERATED OPEN CONDIMENT RAIL

TECHNICAL FIELD

The present invention is directed to the storing of perishable items and more particularly to a method and system for regulating the internal temperature of perishable items in open containers.

BACKGROUND OF THE INVENTION

During preparation, perishable items are often held for extended periods of time in open, easy-to-access containers. For example, many kitchens keep condiments and other frequently used foods in trays that are left open to the warm kitchen environment. As a perishable sits in ambient air, however, it absorbs heat through the surface exposed to the environment by the uncovered top of the tray. This heat absorption causes the perishable's internal temperature to rise, eventually warming the perishable to the temperature of the ambient air. In an attempt to counteract this warming process, trays holding perishables are often placed into "condiment rails" or other similar container systems that are designed to remove the heat added by the environment.

A refrigerated condiment rail is a bin that holds a number of individual, perishable-holding trays cooled using a cooling mechanism. This mechanism, which can range from a simple ice bath to a complex arrangement of refrigeration units, such as a "Bloomington Rail", conductively chills the bottom and side surfaces of the trays. The difference in temperatures creates a temperature gradient between the warmer exposed, perishable surface and the colder tray surfaces. The temperature gradient causes the perishable body to pass the absorbed heat from the exposed perishable surface to the surfaces of the tray (down the temperature gradient). The speed of this transfer is a function of the characteristics of the perishable and the size of the temperature difference. The colder the system is able to make the tray surface, the more quickly the heat can be passed down the gradient. Many perishables become damaged if they are frozen, however, so systems typically keep tray surfaces above −32° F. in order to avoid damaging portions of the perishable near the bottom and sides of the tray.

Systems such as Bloomington Rails typically use conduction to chill the surfaces of the tray, but other methods for chilling the tray surfaces are also used. For example, some systems incorporate forced convection mechanisms that cool the surfaces of a tray by blowing chilled air across them. While forced convection is often less efficient than conduction for the transfer of heat, it is still easily capable of lowering the tray surfaces to the freezing point. In addition, some forced convection systems reduce the temperature of the perishable directly by venting chilled air across the exposed surfaces. This rapidly moving cold air will cool the exposed surface of the perishable further removing the heat added by the environment.

Other systems directly chill the perishable by immersing it in a chilled environment. Chest freezers, for example, hold perishables in an open-topped chamber and continually fill the chamber with cold air. The heavier, colder air amasses in the bottom of the chamber slowly building toward the top. Eventually, all the warmer air is forced out of the chamber completely.

BRIEF SUMMARY OF THE INVENTION

The present invention is directed to systems and methods for maintaining a desired internal temperature in items held in an open container system by reducing the amount of heat the environment is able to transfer to an exposed surface. Example embodiments arranged according to the present invention generate a stationary, insulating layer of cold air that covers the exposed surface and slows or prevents the transfer of heat from the environment.

One example embodiment of the present invention includes a storage container employing a free convection cooling mechanism near or adjacent to an exposed surface of a perishable. The free convection cooling mechanism acts to chill the air immediately above the exposed surface, thereby creating an insulating layer of cold air. By raising or lowering the temperature of this layer, the example embodiment can also raise or lower the internal temperature of the perishable. Accordingly, systems of the present invention can hold a perishable at a desired internal temperature, and also bring perishables placed into the systems to a desired internal temperature.

An example system arranged according to the present invention includes a storage bin designed to hold one or more condiment trays. Refrigeration coils are disposed within at least one wall of the bin and positioned immediately above the edges of the condiment trays. The portions of the bin adjacent to the walls of the tray can be insulated to inhibit heat transfer to the tray from the bin walls. The refrigeration coils are operable to cool the air directly above the edges of each tray, and when cooled, the air settles to form a layer of cold air covering the exposed surface of condiments stored there. This insulating layer of air limits the transfer of heat from the environment to the exposed surface of the condiments.

To help maintain the insulating layer, some embodiments employ an additional set of refrigeration coils arranged above the generated insulating layer. This additional set of coils provides a steady stream of newly chilled air which may replenish the insulating layer when needed. When replenishing is unnecessary, the stream of chilled air flows over the insulating layer providing an additional buffer between the exposed surface of the perishable and the ambient air.

Some embodiments provide additional cooling mechanisms to more rapidly reduce the internal temperature of a perishable. In one such embodiment, one or more fans are disposed behind the additional refrigeration coils and positioned to blow air through the additional refrigeration coils and onto the exposed surface of a perishable. A sensor may be arranged to detect the temperature of the exposed surface of the condiment in each tray and causes an associated fan to turn on when extra cooling is desired.

To help protect the insulating layer from environmental disruptions, some embodiments employ a hood arranged over the top of the bin that inhibits environmental disruptions from disturbing the insulating layer. Alternative embodiments dispose the additional set of refrigeration coils along an interior wall of the hood, and channel any disturbed air toward this interior wall. There the disturbed air is cooled by the additional refrigeration coils and allowed to fall back onto the exposed surface of the condiments.

In many applications, the insulating features of the present invention are so efficient that the internal temperature of the perishable may fall below an acceptable level. To avoid damaging the perishable, some embodiments dispose heating elements on or near the tray surfaces to help keep the temperature of the surfaces above the freezing point.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
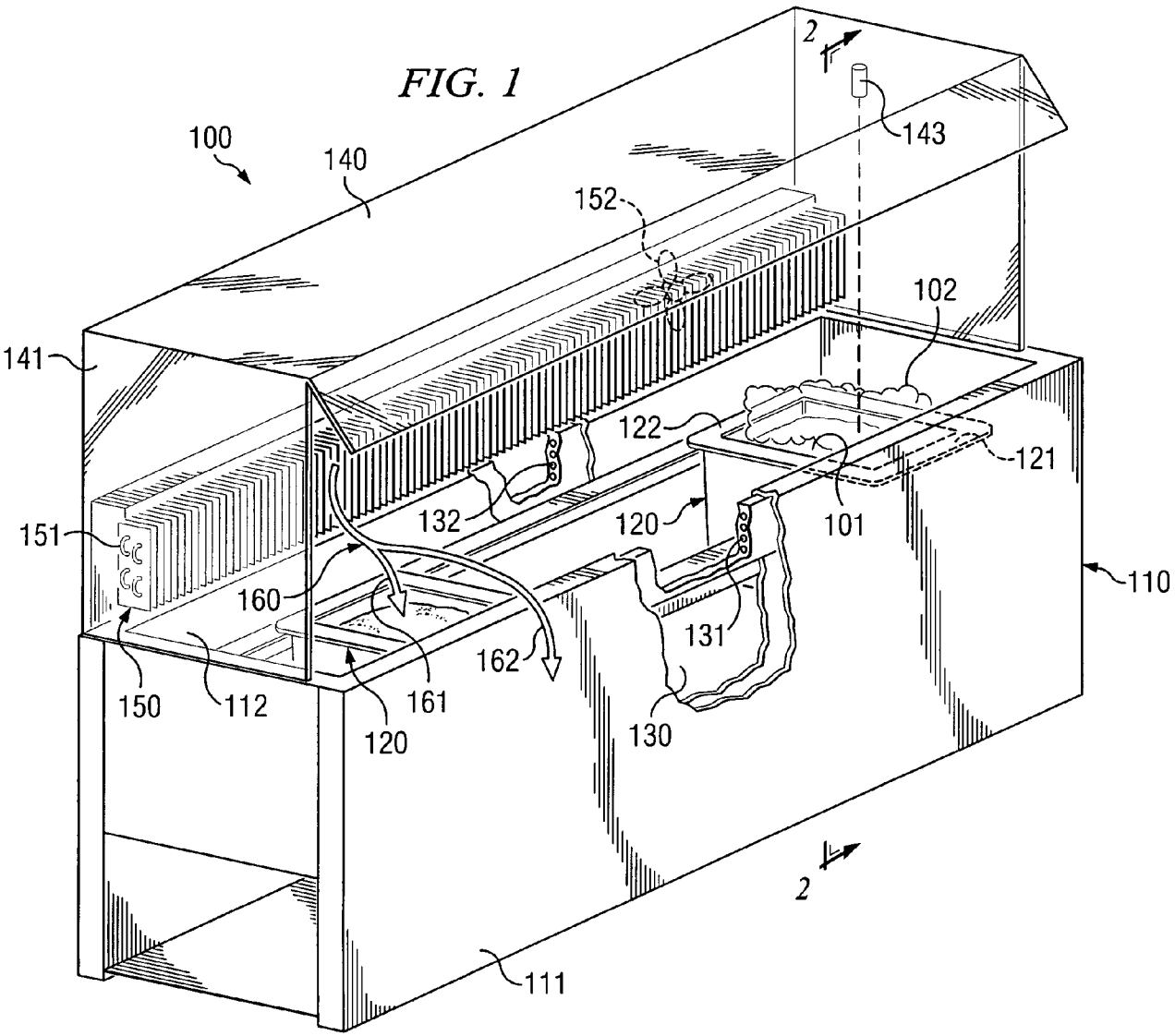
FIG. 1 is an illustration of an example container system arranged according to an embodiment of the present invention.

One purpose of a perishable container system is to hold, or lower, the internal temperature of a perishable below a target temperature. The slope of the temperature gradient created by a traditional system (the temperature difference between the surface of the container and the exposed surface of the perishable) will be a function of the environment's temperature and the characteristics of the perishable itself. Therefore, in order to hold a perishable to a target temperature, a system such as a Bloomington Rail is limited to lowering the temperature of the container surfaces until the temperature gradient permitted by the perishable and the environment, keeps the exposed surface of the perishable at or below the target temperature. Ideally, the perishable body will transfer heat quickly. This allows for shallow gradient slopes that only require the container surface temperature to be slightly below the target temperature. Many perishables, however, do not transfer heat quickly. This requires steep gradient slopes and requires the temperature of the container surfaces to be far below the target temperature. Further, the higher the temperature of the environment, the more heat is passed to the perishable surface. Such environments require traditional systems to pass significant amounts of heat quickly through the perishable body. Extreme environments can lead to steep gradient slopes even in perishables able to quickly pass heat.

The United Sates Food and Drug Administration's Model Food Code for 2001 requires an open air container to be capable of holding the internal temperature of a perishable food at or below 41° F. To comply with this requirement, a Bloomington Rail must lower the temperature of the container surfaces to a temperature that holds surface temperature of the perishable (and thus the temperature of the entire perishable body) at or below 41° F. In many applications, however, the slope of the temperature gradient is too steep to allow the temperature of an exposed perishable surface to be at or below a target temperature of 41° F. while simultaneously keeping the tray surfaces above freezing. In such a circumstance, the environment will transfer more heat to the exposed surface of the perishable than the cooling system is able to extract.

Other traditional systems will have difficulty in these circumstances as well. Forced convection systems, for example, are hampered by the rate at which the forced air warms after being chilled. By the time the chilled air can be vented to cool the exposed surface of the perishable, it is often above the target temperature and can actually warm the exposed surface it is intended to cool. Forced convection systems also tend to dry the surfaces across which they blow and often contaminate the perishable surface with foreign matter caught up in the stream of blown air.

Systems arranged according to the present invention, in contrast, are capable of successfully holding even slow heat conducting perishables at or below 41° F. in very warm environments. Embodiments accomplish this by not relying on being able to remove heat added to the perishable. Instead, embodiments of the present invention work to prohibit the environment from adding heat to the perishable in the first place.

FIG. 1 illustrates an example container system arranged according to one embodiment of the present invention. In system 100, bin 110 holds various perishables 101 in one or more trays 120 suspended over chamber 130. For each tray 120 of the illustrated embodiment, tray front edge 121 rests on a ledge in bin front wall 111, while tray back edge 122 rests in a ledge in bin back wall 112. Within front wall 111, evaporator coils 131 are positioned just above front tray edges 121. Within back wall 112, evaporator coils 132 are positioned just above tray back edges 122. Instead of chilling the surfaces of trays 120, as a Bloomington Rail would, the depicted embodiment of the present invention insulates perishable 101 from the environment by covering the exposed surface of perishable 101 with an insulating layer of cold air 102.

Figure 2:
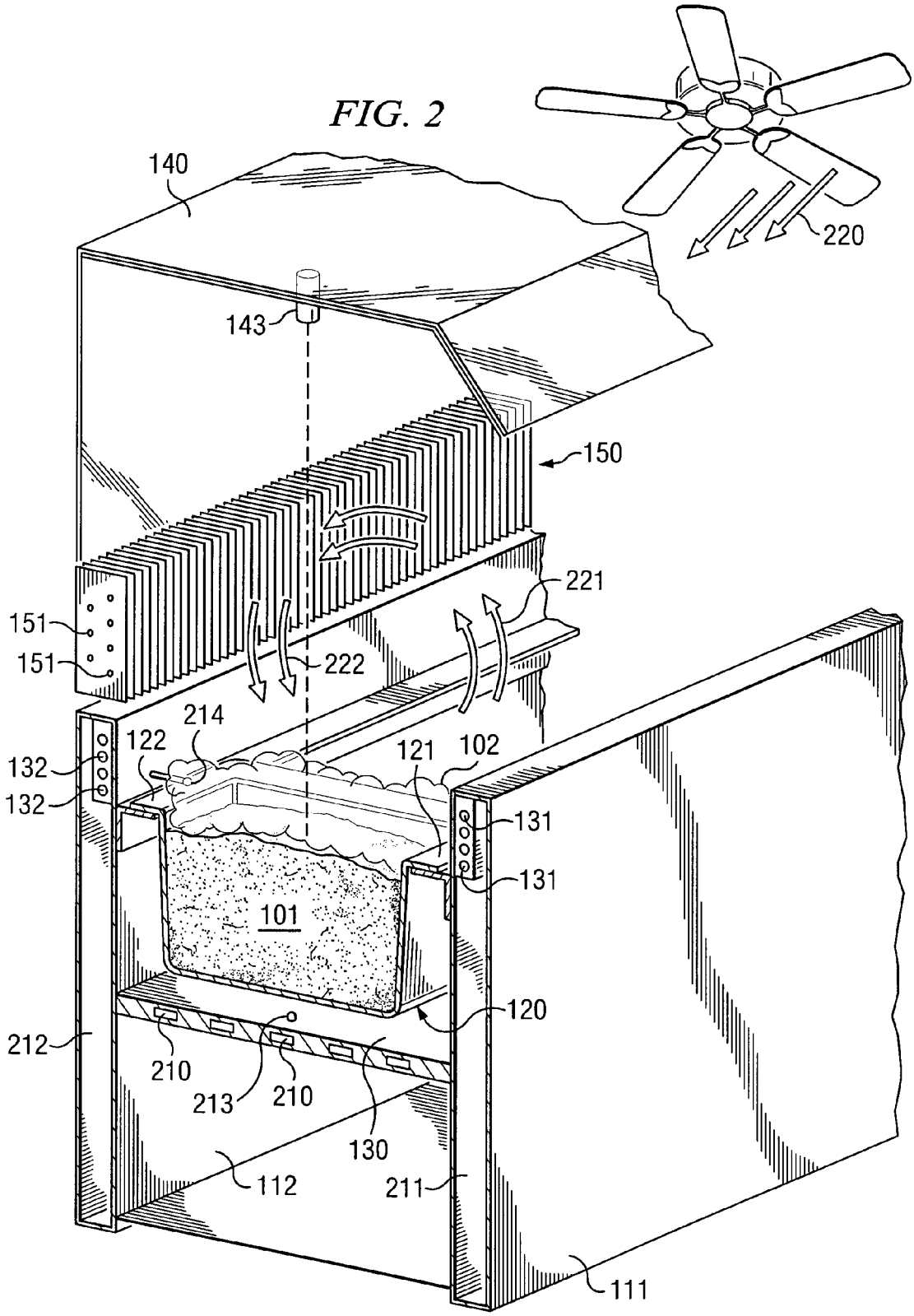
FIG. 2 is an illustration of a cross section of the container of FIG. 1.

FIG. 2 illustrates a cross section of bin 110 and demonstrates the manner of free convection cooling used by the depicted embodiment. Coils 131 and 132 chill the air directly above perishable 101. The newly chilled air, being of higher density than the warmer ambient air, falls down onto the exposed surface of perishable 101 displacing any warmer air already there. If the chilled air warms, then it will rise above the exposed surface of perishable 101 and be replace with air newly chilled by coils 131 and 132. The result is an insulating layer of cold air 102 that, absent an environmental disturbance, will remain stationary over the exposed surface of perishable 101 while being gently replenished by newly chilled air. Sensor 214 may be deployed within layer 102 to monitor its temperature provide to aid in controlling the duty cycles of coils 131 and 132. The embodiments of the present invention are not limited any one type of sensor nor are they limited to the position indicated in the FIGURES. Rather, embodiments may utilize a thermocouple an optical sensor, a thermometer, or any other contact or non-contact arranged in a manner appropriate to the application.

Although the example embodiment of FIGS. 1 and 2 is depicted using evaporator coils, the embodiments of the present invention are not limited to evaporator coils. Rather, embodiments may employ any free convection or conduction mechanism, such as heat sinks, other evaporation methods, gaseous injection, closed or open gas cycles, thermoelectric devices, or the like, to generate insulating layer 102. Nor are the embodiments limited to the disposition of elements depicted, but rather may position cooling apparatuses in any position above the perishable where they are capable of generating a layer of insulating air over an exposed surface, including gas or vapor cycle evaporator in the interior of hood 140, or open gas cycle nozzles positioned above the perishable.

Once generated, insulating layer 102 forms a barrier that slows, or even halts, the transfer of heat between the exposed surface of perishable 101 and the ambient air. By preventing heat from the environment from transferring to Perishable 101, the depicted embodiment can keep perishable 101 below a target temperature (for example the 41° F. required by the FDA model code) indefinitely if layer 102 is kept at or below the target temperature. In addition, because heat transfer can still occur between layer 102 and perishable 101, layer 102 may also be used to adjust the interior temperature of perishable 101. By generating a layer 102 cooler than the internal temperature of perishable 101, heat can be transferred from perishable 101 to layer 102 and the internal temperature of perishable 101 may be lowered. By generating a layer 102 warmer than the internal temperature of perishable 101, then heat can be transferred to perishable 101 from layer 102, and the internal temperature of perishable 101 can be raised. Sensor 143 is an infrared sensor arranged to detect the temperature of the exposed surface of perishable 101, and may be used to help adjust or maintain the interior temperature of perishable 101. Typical embodiments will include similar sensors for each tray 120, but the sensors depicted here are merely examples. The embodiments of the present invention are not limited to this type of sensor nor are they limited to the position indicated in the FIGURES. Rather, embodiments may utilize a thermocouple, a thermometer, or any other contact or non-contact sensor type as well as any appropriate arrangement.

Additional conditioner 150 contains additional evaporator coils 151 which provide one mechanism for protecting layer 102. As depicted in FIG. 1, additional coils 151 chill air above the open top of bin 110. Chilled air 160, being more dense than the warmer ambient air, falls on top of layer 102. Air 160 thus provides an additional source 161 of chilled air for the replenishing of layer 102. Further, because of how additional rail is positioned, any air 162 not needed for the replenishing of layer 102 will continually cascade across layer 102 and over the edge of bin 110, providing an additional barrier between layer 102 and the environment. Information from sensor 143 can also be used to control the operation of additional coils 151, activating or deactivating them as needed.

Although depicted as above and behind bin back wall 112 in FIGS. 1 and 2, additional conditioner 150 is not limited to this positioning. Some embodiments position additional conditioners directly above trays 120, above bin front wall 111, above one or both of the side walls of bin 110, or any other position capable of generating an additional flow of chilled air over layer 102.

Many applications of the present invention are used in environments where moving air may disturb layer 102. For example, embodiments used in kitchens may be effected by fans, vent hoods, air conditioning vents, kitchen staff movements, or other phenomena that cause disruptions in the air around bin 110. Thus, embodiments of the present invention are also capable of tempering these disturbances and quickly reestablishing layer 102. One tempering aspect is additional conditioner 150 which provides a flow of chilled air buffering layer 102 from disturbances in the environment. The illustrated embodiment also arranges hood 140 to cover bin 110 to prevent disturbance in the environment from interfering with layer 102. The front is typically left open for ease of access to perishable 101, but may be equipped with a removable cover, lid, hinged face, or the like. By closing the front of hood 140 (with a roll top door, for example), trays 120 may be isolated from the environment completely, allowing perishables to be more efficiently stored when not used (over night, for example). In the depicted embodiment, hood 140 is closed on three walls, causing disturbed air to be largely contained and directed toward additional rail 150. As depicted in FIG. 2, if disruption 220 disturbs layer 102, disturbed air 221 will encounter additional rail 150. Additional coils 151 cool the disturbed air causing re-cooled air 222 to sink and help replenish layer 102. In the example embodiment depicted, hood 140 houses infrared sensor 143 arranged to detect the temperature of the exposed surface of perishable 101.

Some embodiments of the present invention may include additional cooling mechanisms to increase the rate at which the interior temperature of a perishable may be reduced. In the depicted example, interior back wall 141 of hood 140 holds additional rail 150. Behind additional coils 151, cooling fans 152 may be arranged to direct air through additional coils 151 and onto the exposed surface of the perishables in trays 120, and typical embodiments provide a separate controllable fan for each tray 120. If, for example, a warm perishable is placed into a tray, additional cooling may be desired to quickly bring its internal temperature below the target temperature. Cooling fans can provide a forced convection stream onto the exposed surface of the perishable, to help cool perishable 101 more quickly. The depicted arrangement of fans 152 and coils 151 is only one example of additional cooling mechanisms that may be added. The embodiments of the present invention are not limited to fans 152 and coils 151, but rather may use any additional cooling mechanism for additional cooling of the exposed surfaces.

Some embodiments include mechanisms to defrost the various chilling equipment. In the embodiments of FIG. 1 and FIG. 2, additional coils 151 may frost over do to exposure to a warm, moist environment. To compensate, addition rail 150 can be equipped with a mechanism to reverse the vapor cycle and inject heated gas into the coils 151 until the frost has melted away (hot gas defrost cycle). Defrosting mechanisms may be used with coils 131 and 132 as well, and other defrosting techniques, such as heating elements placed adjacent to coils 151, 131, or 132, could be employed. The embodiments of the present invention are not limited to any one type.

Systems arranged in accordance with the present invention can stand alone or be used to enhance the performance of traditional systems. Chamber 130, for example, may be used to house a traditional mechanism (not shown) for cooling the surfaces of trays 120, such as an ice bath or refrigeration units. By adding elements of the present invention to generate an insulating layer, traditional systems, such as Bloomington Rails, can slow the heat transferred to the perishable from the ambient air, allowing them to operate in more extreme environments and to hold perishables that conduct heat less effectively within the desired temperature range.

Other embodiments of the present invention may be used as alternatives to a gradient-dependent system. Such systems generate an insulating layer 102 that halts most, or even all, of the heat transferred from the environment to perishable 101. Thus only insulating layer 102 may be necessary to cool perishable 101 and maintain its internal temperature below a target value. Returning to FIG. 2, front wall 111 and back wall 112 may be equipped with insulating material 211 and 212, respectively. Alternative embodiments may also insulate the bottom of chamber 130 or insulate tray 120 itself. This insulating material helps limit the heat transferred to perishable 101 from bin 110 thereby improving the ability of bin 110 to maintain the internal temperature of perishable 101.

In many embodiments, the cooling mechanisms of the present invention may be so effective, that some embodiments employ heating elements 210 and sensor 213. If sensor 213 detects that layer 102 has lowered the internal temperature of bin 130 so effectively that the temperature at tray surface 120 is low enough to possible damage perishable 101 (for example, freezing), the system can turn on heating elements 210 to warm the tray and avoid damaging the perishable. In addition, because many embodiments cool perishable 101 so effectively, no particular type of tray 120 is necessary. Embodiments may use plastic, synthetic, or metal trays 120. Some embodiments forgo using trays altogether.

Although the present invention and its advantages have been described in detail, it should be understood that various changes, substitutions and alterations can be made herein without departing from the invention as defined by the appended claims. Moreover, the scope of the present application is not intended to be limited to the particular embodiments of the process, machine, manufacture, composition of matter, means, methods and steps described in the specification. As one will readily appreciate from the disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A method of keeping a perishable between a target temperature and freezing, said method comprising:

holding said perishable in a tray that exposes a surface of said perishable to an environment;

positioning chilling mechanisms above only an edge of said tray; and providing a stationary, insulating layer of air covering said exposed surface, wherein the temperature of said layer is held at or below said target temperature and above freezing.

2. The method of claim 1 further comprising:

suspending said tray in a bin; and generating said layer using a free convection or conduction mechanism positioned above said tray.

3. The method of claim 1 further comprising:

providing insulating material in at least one side wall of said tray.

4. The method of claim 1 further comprising:

providing an additional chilling mechanism above said chilling mechanisms, wherein said additional chilling mechanism provides protection to said layer through free convection.

5. The method of claim 1 further comprising:

providing an additional chilling mechanism above said layer, wherein air cooled by said additional mechanism falls onto said layer.

6. The method of claim 1 further comprising:

detecting a temperature of said exposed surface.

7. The method of claim 6 wherein said detected temperature is used to adjust a duty cycle of a mechanism generating said layer.

8. The method of claim 1 further comprising:

warming a surface of said tray to avoid damaging said perishable.

9. A system for holding a perishable below a target temperature, said system comprising:

a bin arranged to hold at least one tray containing said perishable; and refrigeration coils disposed within a first and second side of said bin and arranged to only cool the air above an exposed portion of said perishable, thereby producing an insulating layer covering said exposed portion;

wherein the perishable is held below the target temperature solely by use of said insulating layer.

10. The system of claim 9 further comprising:

insulating material disposed within at least one wall of said bin.

11. The system of claim 9 further comprising:

a temperature sensor positioned within said layer.

12. The system of claim 11 wherein said temperature sensor is affixed to one of said walls and extended into said layer.

13. The system, of claim 9 further comprising:

a sensor operable to detect the temperature of said exposed portion.

14. The system of claim 13 wherein said sensor is an optical sensor directed to detect a surface temperature of said exposed portion.

15. The system of claim 9 further comprising:

at least one additional refrigeration coil positioned above said layer and operable to cause chilled air to fall onto said layer.

16. The system of claim 15 further comprising:

a hood arranged over said at least one tray, wherein said at least additional coil is disposed within a back wall of said hood.

17. The system of claim 15 further comprising:

at least one fan arranged to direct a flow of air through said additional coil and onto said exposed portion.

18. The system of claim 15 further comprising:

a defrost mechanism operable to defrost at least one of said refrigeration coils.

19. The system of claim 18 wherein said defrost mechanism is operable to stream warm gas through said at least one refrigeration coil.

20. The system of claim 18 wherein said defrost mechanism is a heating element positioned along side said at least one refrigeration coil.

21. A refrigerated condiment rail for holding at least one open topped food storage container, said bin comprising:

a first wall and a second wall arranged to hold said container; and means for free convection cooling operable to chill only air directly above an open side of said container; wherein a temperature of said container is maintained solely by said means for free convection.

22. The rail of claim 21 wherein said free convection cooling means generates a stationary layer of cold air over said open side.

23. The rail of claim 21 further comprising:

means for controlling a temperature of said chilled air.

24. The rail of claim 21 further comprising:

means for sensing a temperature of a food held in said container.

25. The rail of claim 21 further comprising:

means for cooling air above said layer.

26. The rail of claim 25 wherein a portion of said air cooled by said means for cooling air above said layer replenishes said layer, and wherein the remainder isolates said layer from said environment.

27. The rail of claim 21 further comprising:

means for warming at least one side of one said container.

28. A method for keeping a perishable between a target temperature and freezing, said method comprising:

holding said perishable in a container wherein a top surface of said perishable is uncovered;

directly cooling only the air above said top surface, wherein said cooling generates a stationary layer of air above said top surface;

controlling the internal temperature of said perishable using said stationary layer, thereby maintaining said internal temperature of said perishable between said target temperature and freezing.

* * * * *